US008414385B1

(12) United States Patent
Tremblay et al.

(10) Patent No.: US 8,414,385 B1
(45) Date of Patent: Apr. 9, 2013

(54) GAMING SYSTEM, GAMING DEVICE, AND METHOD FOR PROVIDING A SELECTION GAME WITH OFFER AND ACCEPTANCE FEATURES

(75) Inventors: Amanda Tremblay, Reno, NV (US); John H. Zielinski, Reno, NV (US); Nicholas Mayne, Reno, NV (US); William Keith Hughes, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/324,642

(22) Filed: Dec. 13, 2011

(51) Int. Cl.
*A63F 9/24* (2006.01)

(52) U.S. Cl. ..... 463/25; 463/16; 463/20; 273/138.1

(58) Field of Classification Search ..... 463/16–22, 463/25–26; 273/138.1, 139
See application file for complete search history.

(56) References Cited

U.S. PATENT DOCUMENTS 4,582,324 A 4/1986 Koza et al.
5,647,798 A 7/1997 Falciglia
5,791,991 A 8/1998 Small
5,848,932 A 12/1998 Adams
5,855,514 A 1/1999 Kamille
5,931,467 A * 8/1999 Kamille ..... 273/139
5,935,002 A * 8/1999 Falciglia ..... 463/19
6,015,346 A 1/2000 Bennett
6,033,307 A 3/2000 Vancura
6,059,289 A 5/2000 Vancura
6,102,798 A 8/2000 Bennett
6,149,156 A 11/2000 Feola
6,159,097 A 12/2000 Gura
6,159,098 A 12/2000 Slomiany et al.
6,174,235 B1 1/2001 Walker et al.
6,186,894 B1 2/2001 Mayeroff
6,190,255 B1 2/2001 Thomas et al.
6,224,483 B1 5/2001 Mayeroff
6,231,442 B1 5/2001 Mayeroff
6,261,177 B1 7/2001 Bennett
6,303,469 B1 10/2001 Larson et al.
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,664 B1 11/2001 Baerlocher et al.
6,319,124 B1 11/2001 Baerlocher et al.
6,346,043 B1 2/2002 Colin et al.
6,347,996 B1 2/2002 Gilmore et al.
6,358,147 B1 3/2002 Jaffe
6,364,767 B1 4/2002 Broussard et al.
6,375,187 B1 4/2002 Baerlocher
6,379,251 B1 4/2002 Auxier et al.
6,398,218 B1 6/2002 Vancura
6,439,995 B1 8/2002 Hughs-Baird et al.

(Continued)

*Primary Examiner* — Michael Cuff
*Assistant Examiner* — Alex F. R. P. Rada, II
(74) *Attorney, Agent, or Firm* — Neal, Gerber & Eisenberg LLP

(57) ABSTRACT

A gaming system including a secondary game which incorporates different types of player decisions which affect different aspects of the play of the secondary game. Specifically, one or more gaming system determinations associated with a play of the primary game coupled with one or more player wagering or purchasing decisions made prior to the play of the secondary game, determine one or more features, attributes or parameters of the secondary game. Additionally, one or more player selections associated with the play of the secondary game, coupled with one or more player strategy decisions pertaining to the continued play of the secondary game, determine the secondary game award provided to the player.

20 Claims, 15 Drawing Sheets

U.S. PATENT DOCUMENTS 6,450,883 B1 9/2002 O'Halloran
6,506,118 B1 1/2003 Baerlocher et al.
6,511,375 B1 1/2003 Kaminkow
6,514,141 B1 2/2003 Kaminkow et al.
6,558,254 B2 5/2003 Baelocher et al.
6,592,457 B1 7/2003 Frohm et al.
6,595,854 B2 7/2003 Hugh-Baird et al.
6,599,185 B1 7/2003 Kaminkow et al.
6,602,137 B2 8/2003 Kaminkow et al.
6,607,438 B2 8/2003 Baerlocher et al.
6,632,141 B2 10/2003 Webb et al.
6,648,754 B2 11/2003 Baerlocher et al.
6,676,516 B2 1/2004 Baerlocher et al.
6,692,356 B2 2/2004 Baerlocher et al.
6,722,981 B2 4/2004 Kaminkow et al.
6,722,982 B2 4/2004 Kaminkow et al.
6,733,386 B2 5/2004 Cuddy et al.
6,749,504 B2 6/2004 Hughs-Baird
6,769,983 B2 8/2004 Slomiany
6,780,107 B2 * 8/2004 Baerlocher et al. ..... 463/16
6,783,457 B2 8/2004 Hughs-Baird et al.
6,875,108 B1 4/2005 Hughs-Baird
6,899,620 B2 5/2005 Kaminkow et al.
6,932,701 B2 8/2005 Glavich et al.
6,960,132 B2 11/2005 Baerlocher et al.
6,966,833 B2 11/2005 Kaminkow et al.
7,029,395 B1 4/2006 Baerlocher
7,040,984 B2 5/2006 Mead
7,112,137 B2 9/2006 Baerlocher et al.
7,160,186 B2 1/2007 Cuddy et al.
7,160,188 B2 1/2007 Kaminkow et al.
7,182,689 B2 2/2007 Hugh-Baird et al.
7,264,545 B2 9/2007 Maya et al.
7,273,415 B2 9/2007 Cregan et al.
7,316,609 B2 1/2008 Dunn et al.
7,329,179 B2 2/2008 Baerlocher
7,331,864 B2 2/2008 Baerlocher
7,364,159 B2 4/2008 Berman et al.
7,371,166 B1 5/2008 Webb et al.
7,566,272 B2 7/2009 Gerrard et al.
7,601,058 B2 10/2009 Slomiany
7,722,451 B2 5/2010 Hughs-Baird et al.
7,731,582 B2 6/2010 Randall et al.
7,785,195 B2 8/2010 Palmer et al.
7,794,316 B2 9/2010 Palmer et al.
7,887,412 B2 2/2011 Baerlocher
7,901,287 B2 3/2011 Simms et al.
7,914,372 B2 3/2011 Tessmer et al.
7,963,842 B2 6/2011 Ruymann
2001/0024970 A1 9/2001 McKee et al.
2002/0052232 A1 5/2002 Kaminkow
2003/0040358 A1 2/2003 Rothkranz et al.
2004/0110555 A1 6/2004 Devaull et al.
2005/0026673 A1 * 2/2005 Paulsen et al. ..... 463/16
2005/0054429 A1 3/2005 Baerlocher
2005/0054435 A1 3/2005 Rodgers et al.
2005/0056999 A1 3/2005 Roemer et al.
2005/0060050 A1 3/2005 Baerlocher
2005/0096123 A1 5/2005 Cregan
2006/0025195 A1 * 2/2006 Pennington et al. ..... 463/16
2007/0015566 A1 1/2007 Baerlocher et al.
2007/0060271 A1 3/2007 Cregan et al.
2007/0129131 A1 6/2007 Kaminkow et al.
2007/0149269 A1 6/2007 Benbrahim
2008/0004105 A1 1/2008 Cregan et al.
2008/0227538 A1 9/2008 Kelly et al.
2008/0318668 A1 12/2008 Ching et al.
2010/0004044 A1 1/2010 Slomiany

* cited by examiner

GAMING SYSTEM, GAMING DEVICE, AND METHOD FOR PROVIDING A SELECTION GAME WITH OFFER AND ACCEPTANCE FEATURES

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Selection games are one such type or secondary or bonus game. In one known selection game, a player has one or more opportunities to pick masked awards from a group of symbols displayed to the player. When the player picks a masked symbol, the game removes the mask and reveals any award associated with the masked symbol. This process continues until either the player has no remaining opportunities to pick any masked symbols or a picked symbol reveals a terminator which terminates the selection game. Enabling a player to pick one or more selections to determine that player's award provides enjoyment and excitement for players. There is a continuing need to increase this enjoyment and excitement for players.

Offer and acceptance games are another such type of secondary or bonus game. In one known offer and acceptance game, the game provides the player with up to three randomly determined offers and a final award. In this known game, when an offer is given, the player may accept or reject it. If the player accepts an offer, the player receives the accepted offer amount and the offer and acceptance game terminates. If the player declines an offer, the game randomly generates another offer for the player. The player is automatically provided with the last selected offer if the player rejects the three previous offers. In this known offer/acceptance game, when the player rejects an offer, the player risks a current or guaranteed award for a higher value award. However, the game may instead provide a lower award, thus creating a risk for the player. Enabling a player to pick from different risk based alternatives provides enjoyment and excitement to the player. There is a continuing need to increase this enjoyment and excitement for players.

SUMMARY

The present disclosure relates generally to gaming systems, gaming devices, and methods for providing a selection game with offer and acceptance features.

In various embodiments, the gaming system disclosed herein provides a secondary game which incorporates different types of player decisions which affect different aspects of the play of the secondary game. Specifically, one or more gaming system determinations associated with a play of the primary game coupled with one or more player wagering or purchasing decisions made after the triggering, but prior to the play of the secondary game, determine one or more features, attributes or parameters of the subsequently played secondary game. Additionally, one or more player selections associated with the play of the secondary game, coupled with one or more player strategy decisions pertaining to the continued play of the secondary game, determine the secondary game award provided to the player. Such a configuration increases the player's involvement in determining the player's award in the secondary game, which in turn increases the player's level of enjoyment and excitement.

More specifically, in one embodiment, upon an occurrence of a secondary game triggering event, the gaming system determines an amount of budget credits or units for a play of a secondary game. In this embodiment, after determining the amount of budget credits for the play of the secondary game, but before enabling the player to participate in the secondary game, the gaming system enables the player to purchase additional budget credits. This amount of player purchased budget credits plus the determined amount of budget credits form a player's secondary game budget for the subsequent play of the secondary game. Accordingly, the gaming system of this embodiment enables a player to monetarily contribute to a triggered, but not yet played, secondary game wherein the monetary contribution is utilized in the subsequent play of the triggered secondary game.

It should be appreciated that by enabling the player to use wagering credits (or promotional credits) to add to their amount of budget credits, at least one embodiment of the gaming system disclosed herein enables a player to at least partially control the amount of time the player will participate in the secondary game. That is, as described below, the amount of budget credits in a player's budget determines, at least in part, the quantity of picks the player may make in the secondary game. This quantity of picks corresponds to both a duration the player may participate in the secondary game and the award provided to the player in the secondary game. For example, a larger secondary game budget corresponds, on average, to more picks in the secondary game which corresponds, on average, to both more time spent playing the secondary game and more opportunities to win awards in the secondary game. Accordingly, the present disclosure is configured such that the player's post-secondary game trigger wagering or purchasing decisions determine one or more features, attributes or parameters of the triggered secondary game.

In one embodiment, after determining an amount of budget credits and enabling the player to purchase any additional budget credits, the gaming system initiates a play of the secondary game. The play of the secondary game includes displaying a plurality of selections to a player. One or more of the selections are each associated with a masked award. Specifically: (i) zero, one or more of the selections are each associated with a multiplier value which, if revealed, increments a secondary game modifier, such as a secondary game multiplier and does not modify the amount of budget credits in the player's budget, (ii) zero, one or more of the selections are each associated with an additional pick which, if revealed, provides the player an additional pick of the selections and does not modify the amount of budget credits in the player's budget, and (iii) zero, one or more of the selections are each associated with an amount of award credits which, if revealed, modify a secondary game award meter and modify the amount of budget credits in the player's budget. In one embodiment, in addition to being associated with a masked award, one or more of the selections are each associated with a displayed virtual item or good, such as an item for a player's avatar. In this embodiment, if a player picks a selection associated with a displayed virtual item or good, the displayed virtual item or good is accumulated for the player's avatar and remains associated with the player's avatar after the conclusion of the secondary game. Such an embodiment thus provides a player an opportunity to both win awards and accumulate avatar virtual items or goods in association with the same play of a secondary game.

In operation of one embodiment, prior to making each pick, the gaming system displays to the player the amount of budget credits in the player's secondary game budget and enables the player to either pick one of the selections or exit the secondary game with at least their amount of budget credits. Such displaying of the amount of budget credits in the player's secondary game budget enables the player to make an informed decision regarding whether to continue the play of the secondary game or end the play of the secondary game.

If the player exits the secondary game (i.e., if the player accepts an offer of a secondary game award of at least their amount of budget credits), the gaming system: (i) transfers the player's amount of budget credits in the secondary game budget to a secondary game award meter, (ii) modifies the amount in the secondary game award meter by the secondary game modifier, such as the secondary game multiplier, (iii) provides this modified amount to the player, and (iv) ends the play of the secondary game. For example, if a player's secondary game budget includes one-hundred budget credits, a multiplier for the play of the secondary game has previously incremented to 3× and the player decides to exit the secondary game, the gaming system transfers the one-hundred budget credits from the player's secondary game budget to the player's secondary game award meter, modifies the secondary game award meter by the multiplier of 3×, provides the player a total secondary game award of three-hundred award credits and ends the secondary game.

On the other hand, if the player picks one of the selections (i.e., if the player rejects the offer of a secondary game award of at least their amount of budget credits), the gaming system reveals the award associated with the picked selection.

If the gaming system reveals a multiplier value associated with the picked selection, the gaming system increments the secondary game multiplier for the play of the secondary game and does not modify (e.g., reduce) the amount of budget credits in the player's secondary game budget (i.e., a revealed multiplier value represents an additional award that does not cost the player any budget credits). Similarly, if the gaming system reveals an additional pick associated with the picked selection, the gaming system provides the player an additional pick of the selections and does not modify (e.g., reduce) the amount of budget credits in the player's secondary game budget (i.e., a revealed additional pick represents an additional award that does not cost the player any budget credits either with the selection of the additional pick or with the subsequent use of the additional pick in picking another selection).

If the gaming system reveals an award of an amount of credits associated with the picked selection, the gaming system determines how this revealed amount of award credits compares to the amount of budget credits in the player's secondary game budget. Specifically, if the gaming system reveals an award of an amount of award credits associated with the picked selection and the amount of budget credits in the player's secondary game budget is greater than this amount of award credits, the gaming system transfers this revealed amount from the player's secondary game budget to the secondary game award meter. For example, if a player's budget includes one-hundred budget credits and the picked selection is revealed to be associated with an award of fifty award credits, the gaming system accumulates fifty award credits in the secondary game award meter and reduces the player's secondary game budget by fifty budget credits (i.e., the picked selection cost the player fifty budget credits). As seen in this example, the gaming system is configured to convert a player's budget credits (which are obtained either as a result of one or more gaming system determinations or as a result of the player contributing monetary credits to purchase such budget credits) to award credits.

If the gaming system reveals an award of an amount of award credits associated with the picked selection and the amount of budget credits in the player's secondary game budget is less than this amount of award credits, the gaming system: (i) transfers the amount of budget credits remaining in the player's secondary game budget to the secondary game award meter (to result in a player budget of zero budget credits), (ii) provides the amount in the secondary game award meter to the player, and (iii) ends the play of the secondary game. For example, if a player's secondary game budget includes one-hundred budget credits, a multiplier for the play of the secondary game has previously incremented to 3×, and the picked selection is revealed to be associated with an award of one-hundred-fifty award credits, the gaming system accumulates one-hundred award credits in the secondary game award meter, reduces the player's budget by one-hundred budget credits and provides the player the amount of award credits in the player's secondary game award meter. As seen in this example, if the player picks a selection associated with a value that exceeds their secondary game budget, the gaming system does not modify the secondary game award meter by any secondary game multiplier. Accordingly, the gaming system of this embodiment is configured to cause the player to forfeit any previously accumulated multiplier (and thus potentially forfeit a lucrative award) if the player proceeds with the selection game and is unable to demonstrate the ability to stay on budget in picking selections.

If the gaming system reveals an award of an amount of award credits associated with the picked selection and the amount of budget credits in the player's secondary game budget is equal to this amount of award credits, the gaming system: (i) transfers this amount of award credits to the secondary game award meter, (ii) modifies the amount of budget credits in the player's budget by this amount of award credits (to result in a player's secondary game budget of zero budget credits), and (iii) increments the secondary game modifier, such as the secondary game multiplier, by a designated multiplier value. The gaming system then: (iv) modifies the amount in the secondary game award meter by the secondary game modifier, such as the secondary game multiplier, (v) provides this modified amount to the player and, (vi) ends the play of the secondary game. For example, if a player's secondary game budget includes one-hundred budget credits, a multiplier for the play of the secondary game has previously incremented to 3× and the picked selection is revealed to be associated with an award of one-hundred award credits, the gaming system accumulates one-hundred award credits in the secondary game award meter and reduces the player's secondary game budget by one-hundred budget credits. The gaming system also increases the current secondary game multiplier to 8× and modifies the secondary game award meter by this increased secondary game multiplier. As seen in this example, the gaming system of this embodiment is configured to provide the player a relatively lucrative award if the player proceeds with the selection game and demonstrates the ability to stay on budget in picking selections.

After revealing the award associated with the picked selection, if the player has an amount greater than zero budget credits remaining in their budget, the gaming system again enables the player to either pick one of the selections or exit the secondary game as described above. This process continues until the secondary game ends by one of: (i) the player deciding to discontinue play of the secondary game, (ii) the gaming system revealing an award of an amount of award credits associated with a picked selection which is greater than the amount of budget credits in the player's secondary game budget, or (iii) the gaming system revealing an award of an amount of award credits associated with a picked selection which is equal to the amount of budget credits in the player's secondary game budget.

Accordingly, the gaming system of the present disclosure incorporates an element of player strategy because prior to each pick, the player may decide to: (i) end the play of the secondary game and thus retain a currently incremented secondary game multiplier (while forfeiting the opportunity to further increment the secondary game multiplier), or (ii) continue on with the play of the secondary game and thus continue trying to increment the secondary game multiplier (while potentially risking any previous increase of the secondary game multiplier). Put differently, the gaming system of the present disclosure presents the player with the competing interests of attempting to increase a secondary game multiplier by picking another selection versus risking going over the budget and losing any previous increase of the secondary game modifier, such as a secondary game multiplier.

The gaming system and method of the present disclosure thus provides a selection secondary game with offer and acceptance features wherein: (i) one or more player wagering or purchasing decisions, determine one or more features, attributes or parameters of the secondary game, and (ii) one or more player strategy decisions determine the secondary game award provided to the player. Such a configuration increases the player's involvement with the play of the secondary game and thus increases the player's level of enjoyment and excitement.

Additional features and advantages are described in, and will be apparent from, the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
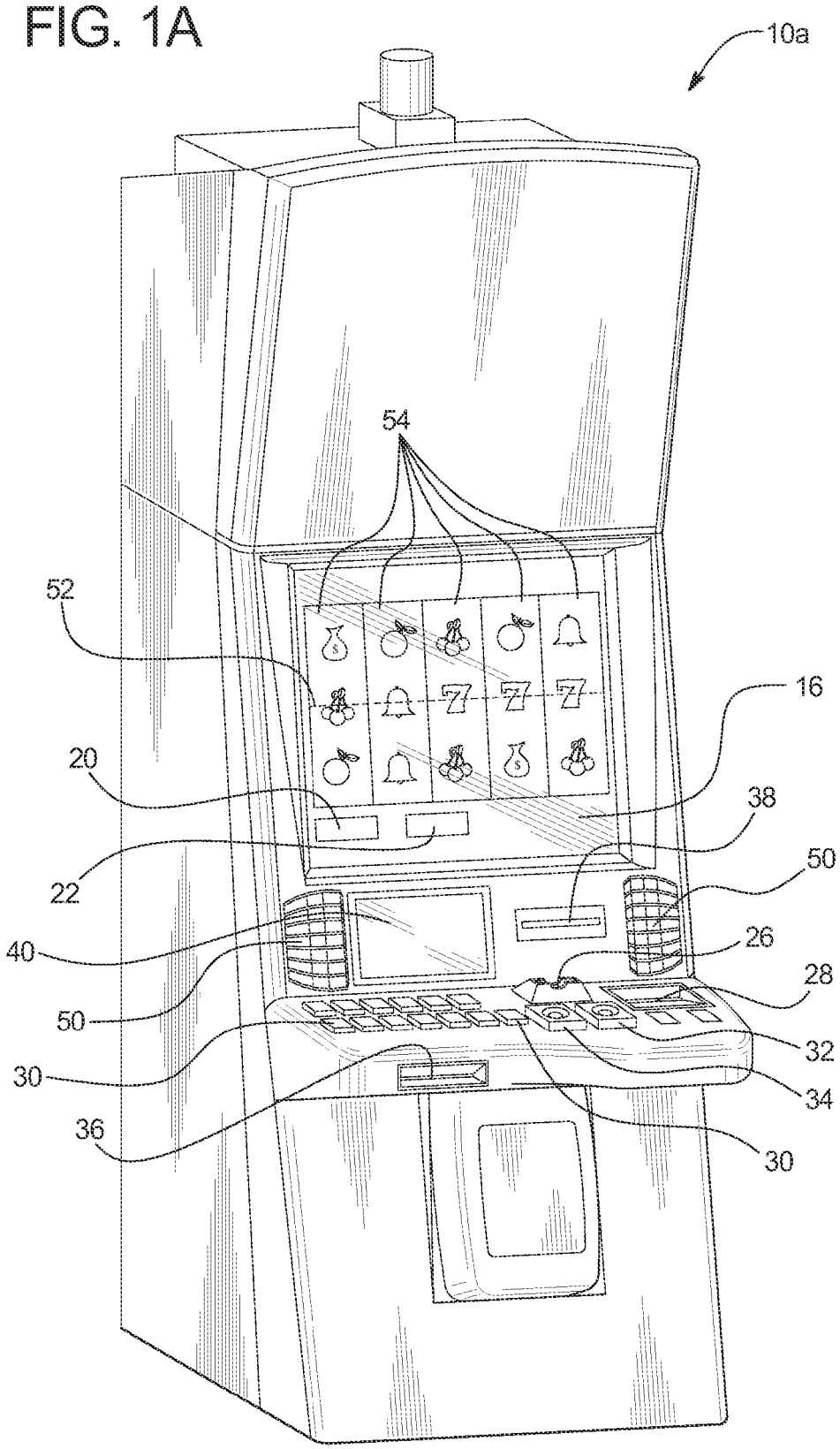
FIGS. 1A and 1B are perspective views of example alternative embodiments of the gaming device of the present disclosure.
Figure 1B:
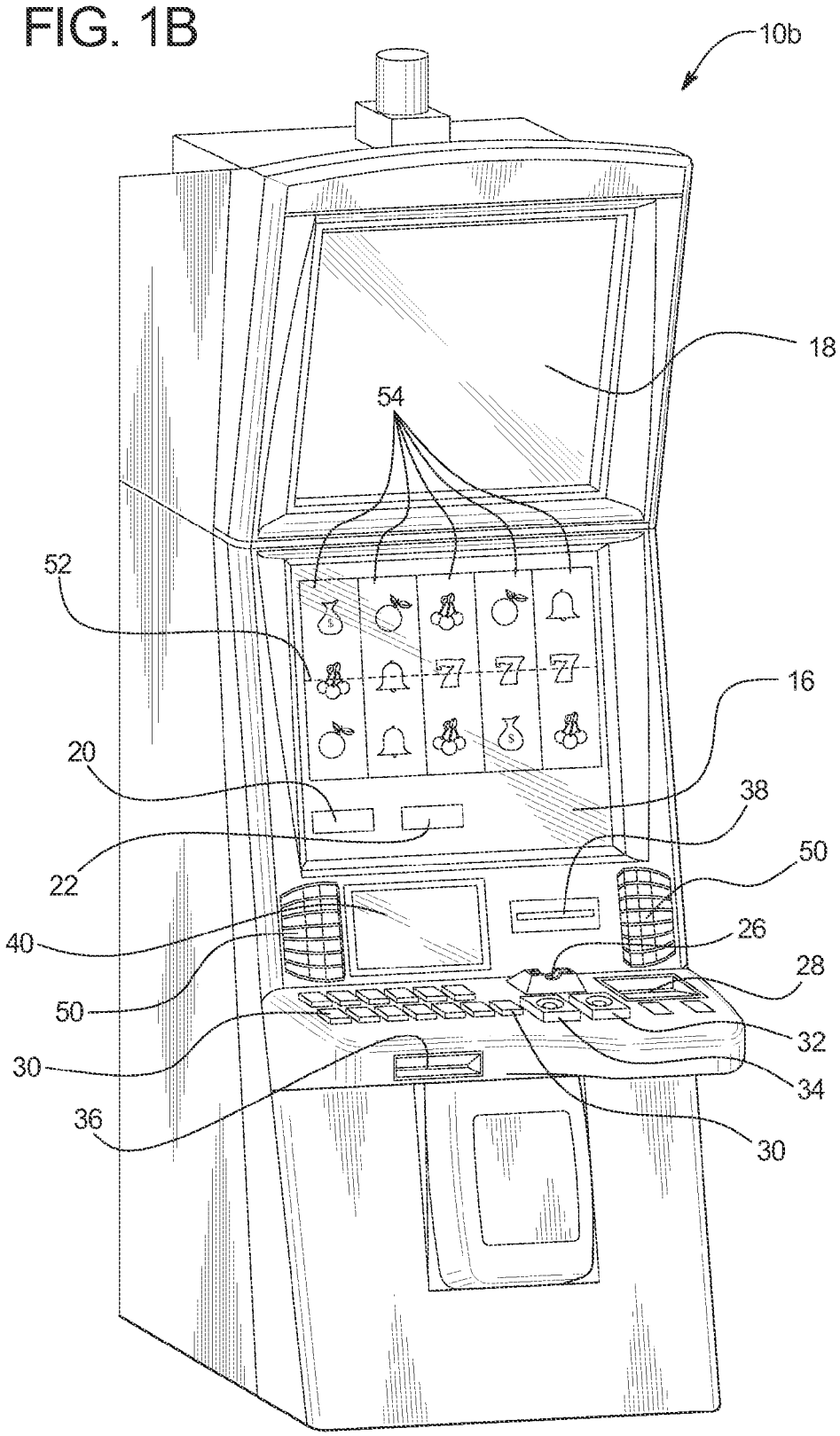

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
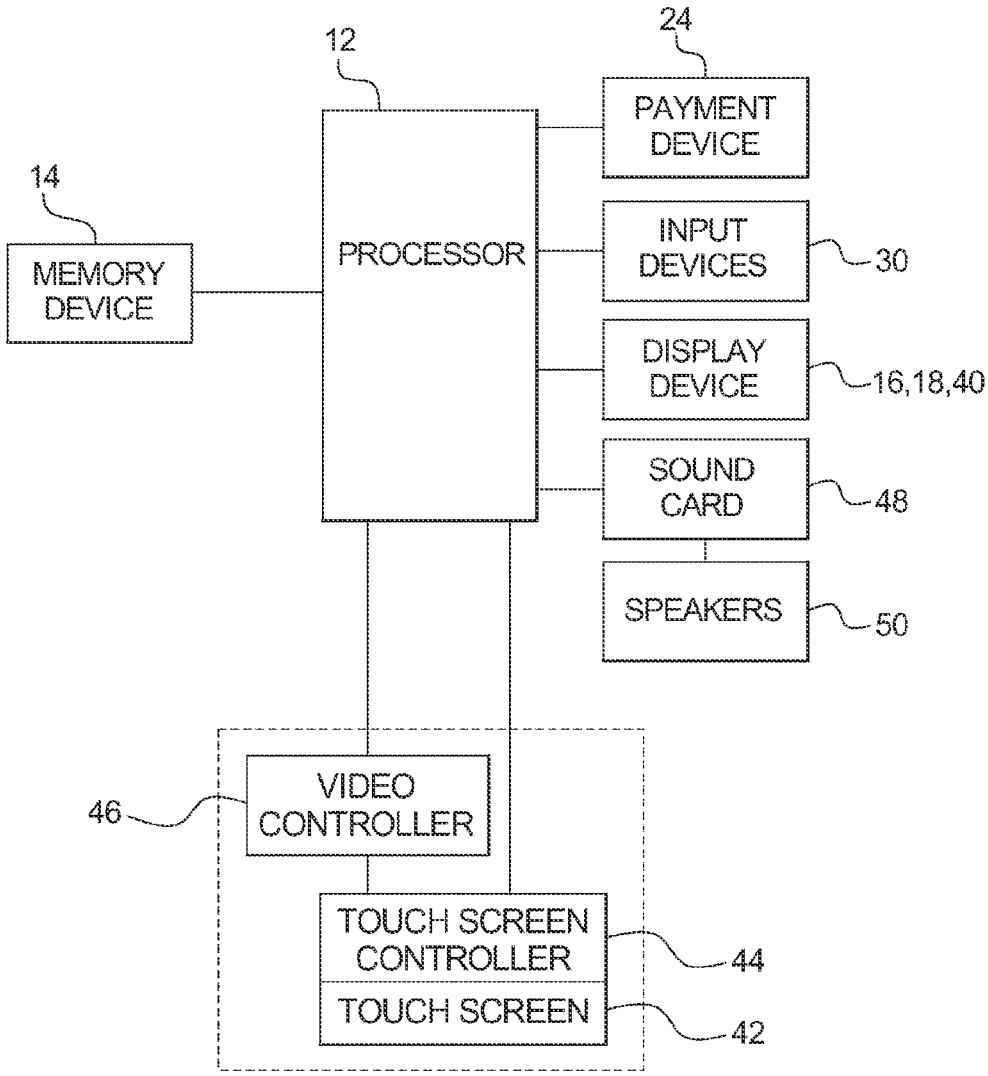
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a hand-held device, such as a personal digital assistant (PDA), a portable computing or mobile device, or another computerized platform to implement the present disclosure. In one embodiment, the gaming device or gaming machine disclosed herein is operable over a wireless network, for example as part of a wireless gaming system. In one such embodiment, the gaming machine may be a hand-held device, a mobile device, or any other suitable wireless device that enables a player to play any suitable game at a variety of different locations. In various embodiments in which the gaming device or gaming machine is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. In one embodiment, the disclosed multi-dimensional cascading symbol game is implemented as a base or primary game.

In one embodiment, as illustrated in FIGS. 1A and 1B, a base or primary game may be a slot game with one or more paylines 52. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player.

In one embodiment, one or more of the paylines may be horizontal, vertical, circular, diagonal, angled or any combination thereof. In another embodiment, one or more of the paylines each include a plurality of adjacent symbol display positions on a requisite number of adjacent reels. In one such embodiment, one or more paylines are formed between at least two symbol display positions which are adjacent to each other by either sharing a common side or sharing a common corner (i.e., such paylines are connected paylines). In these embodiments, the gaming device enables a player to wager on one or more of such paylines to activate such wagered on paylines.

In another embodiment wherein one or more paylines are formed between at least two symbol display positions which are adjacent to each other, the gaming device enables a player to wager on and thus activate a plurality of symbol display positions. In this embodiment, one or more paylines which are formed from a plurality of adjacent active symbol display positions on a requisite number of adjacent reels are activated.

In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol display positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol display positions by one or more of the reels modifies the number of ways to win.

In another embodiment, the gaming device enables a player to wager on and thus activate symbol display positions. In one such embodiment, the symbol display positions are on the reels. In this embodiment, if based on the player's wager, a reel is activated, then each of the symbol display positions of that reel will be activated and each of the active symbol display positions will be part of one or more of the ways to win. In one embodiment, if based on the player's wager, a reel is not activated, then a designated number of default symbol display positions, such as a single symbol display position of the middle row of the reel, will be activated and the default symbol display position(s) will be part of one or more of the ways to win. This type of gaming machine enables a player to wager on one, more than one or all of the reels and the processor of the gaming device uses the number of wagered on reels to determine the active symbol display positions and the number of possible ways to win. In alternative embodiments, (1) no symbols are displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol display position on a first reel forms part of a winning symbol combination with or is otherwise suitably related to a symbol generated in an active symbol display position on a second reel. In this embodiment, the gaming device classifies each pair of symbols which form part of a winning symbol combination (i.e., each pair of related symbols) as a string of related symbols. For example, if active symbol display positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. In one embodiment, the disclosed multi-dimensional cascading symbol game is implemented as a bonus or secondary game. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
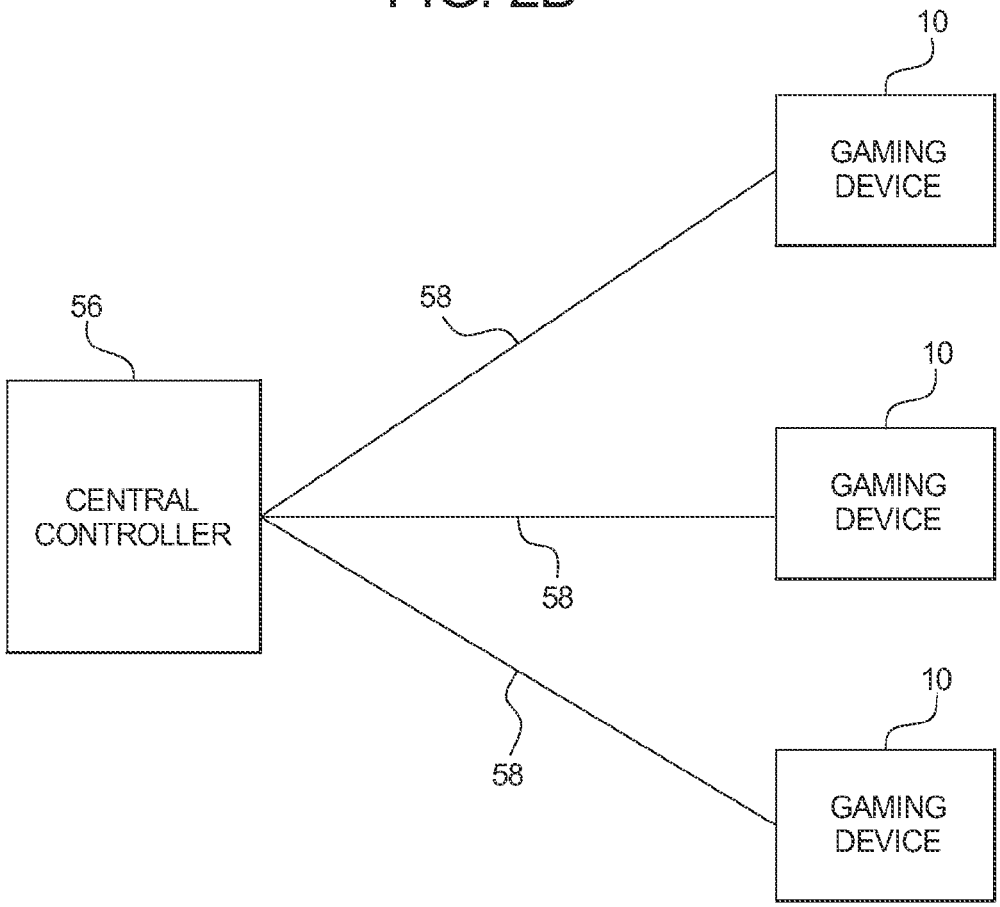
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play.

In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Budget Based Secondary Game

Figure 3:
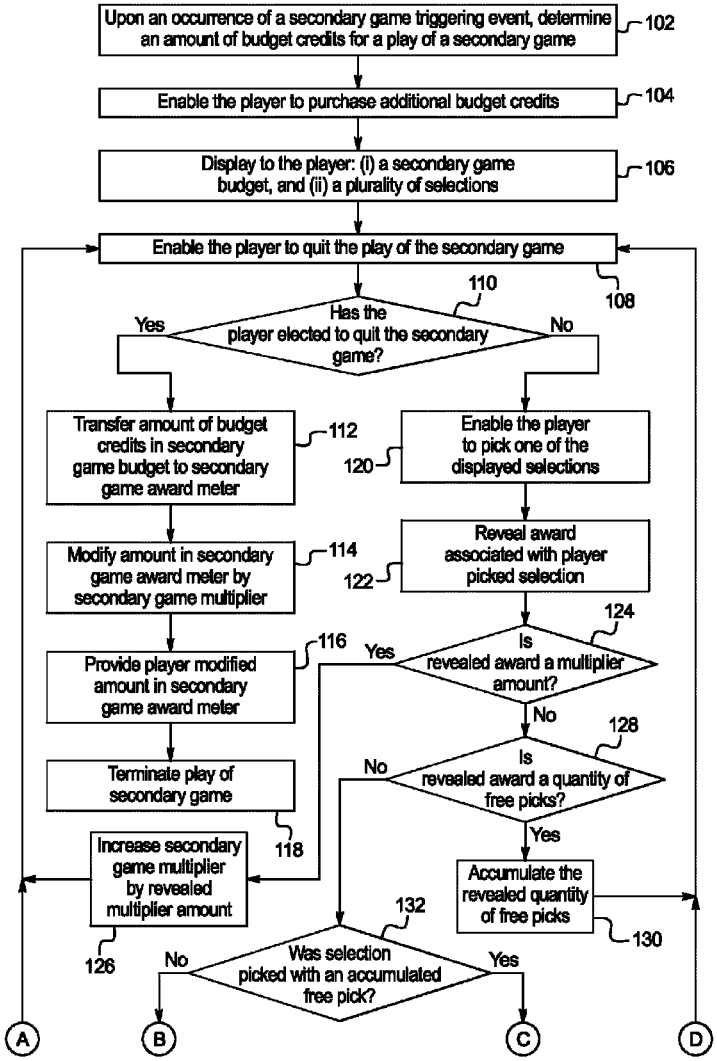
FIG. 3 is a flow chart an example process for operating a gaming system providing the secondary game disclosed herein.
Figure 3:
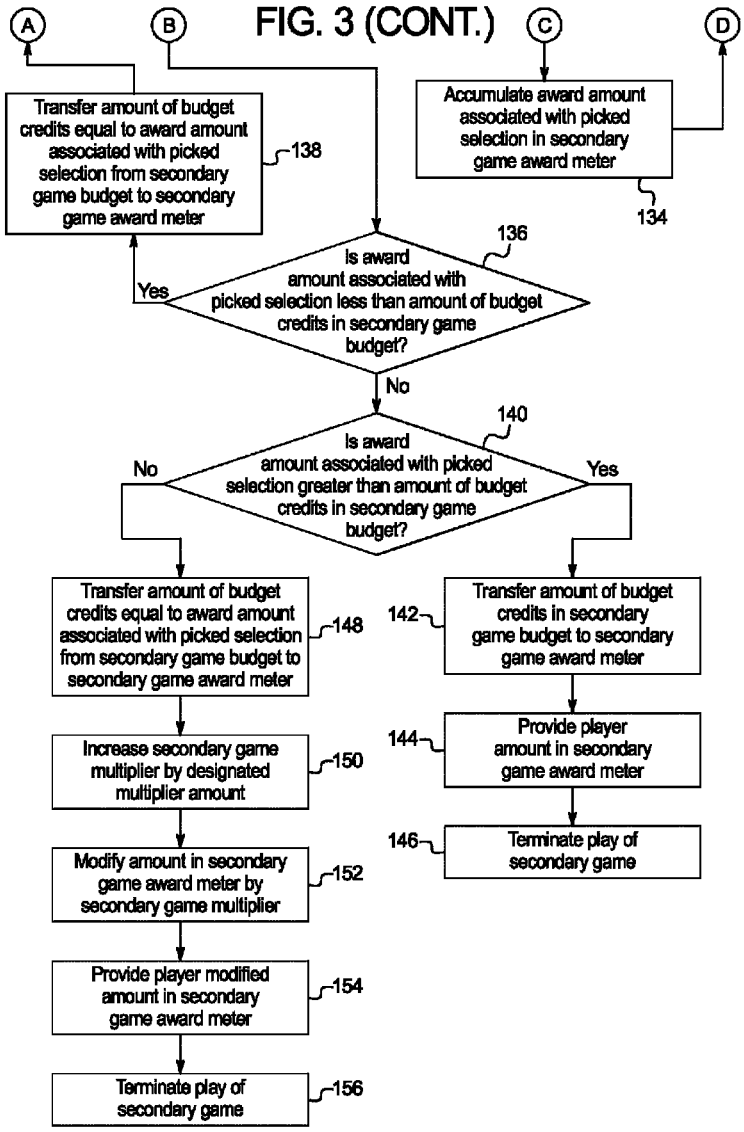

Referring now to FIG. 3, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 3, it should be appreciated that many other methods of performing the acts associated with this process may be used. For example, the order of certain steps described may be changed, or certain steps described may be optional.

As seen in FIG. 3, in one embodiment, upon an occurrence of a secondary game triggering event, the gaming system determines an amount of budget credits or units for a play of a secondary game as indicated in block 102. In one embodiment, a secondary game triggering event occurs based on at least one displayed event occurring in association with a play of a primary game, such as a designated symbol combination being generated. In another embodiment, a secondary game triggering event occurs independent of any displayed events in any plays of any of the primary games, such as a mystery event. It should be appreciated that in one embodiment, the budget credits or units disclosed herein are different, separate and independent from any monetary based points or credits, any promotional based points or credits, or any player tracking points. In other words, in this embodiment, the budget credits or units disclosed herein are not directly redeemable for direct currency and are further not associated with a player's point balance in a player's player tracking account.

Figure 4A:
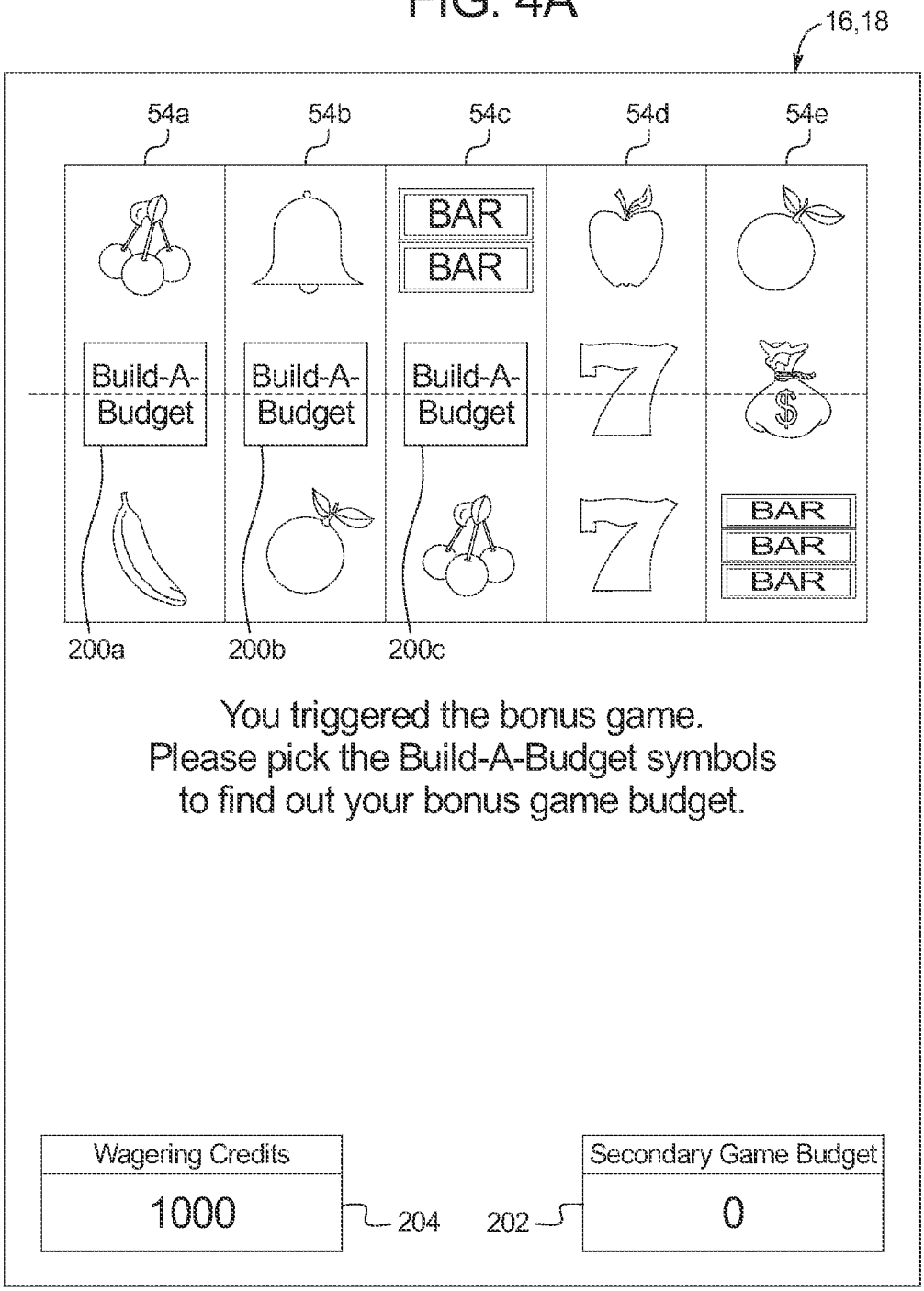
FIGS. 4A, 4B and 4C are front views of one embodiment of the gaming system disclosed herein illustrating a determination of a player's secondary game budget for a play of a secondary game.
Figure 4B:
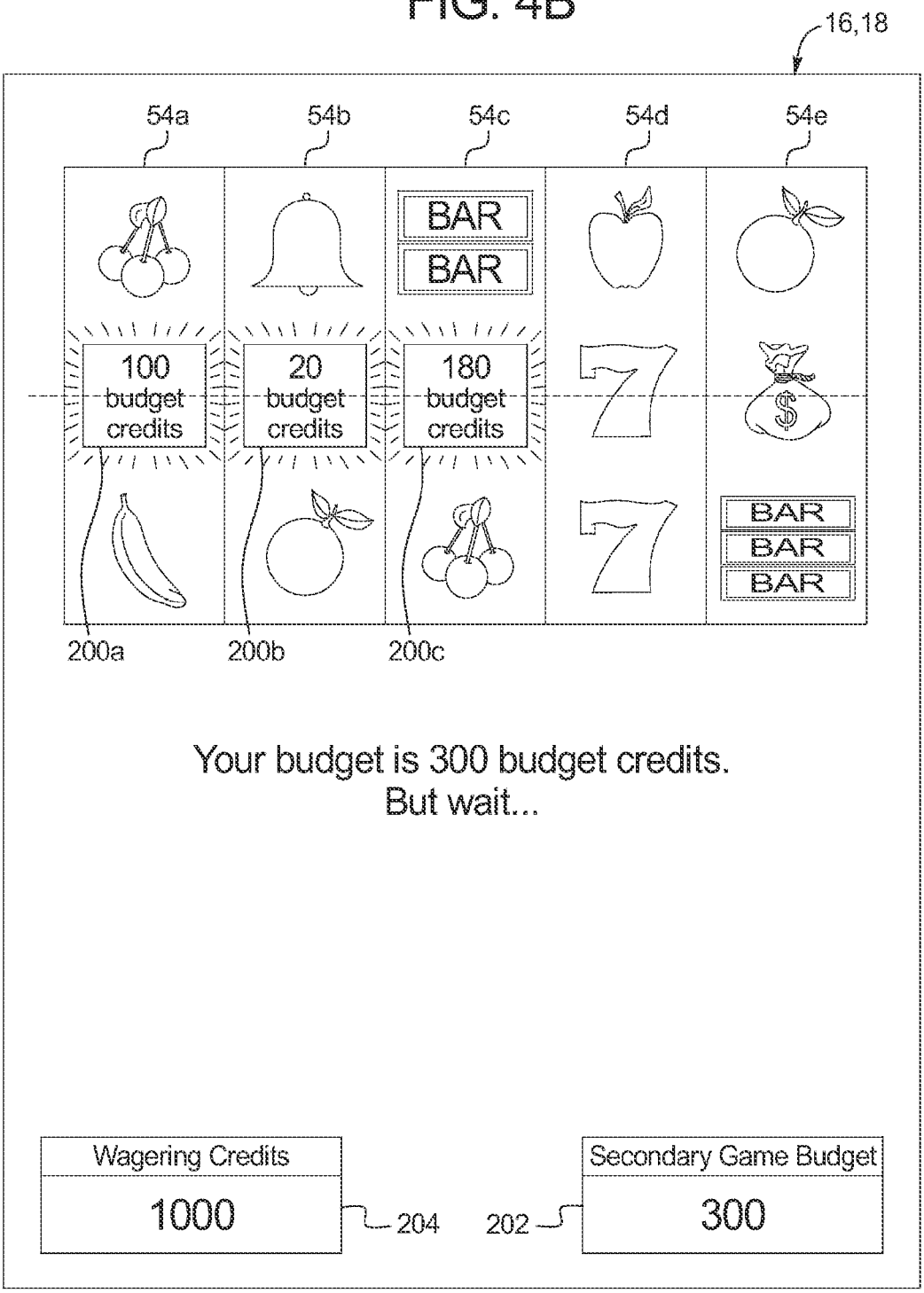

In one embodiment, the gaming system determines an amount of budget credits for a play of a secondary game based the secondary game triggering event which occurred. In one such embodiment, if the secondary game triggered event includes a generation of one or more designated symbols in the play of the primary game, then the amount of budget credits is based on the quantity of designated symbols generated. In this embodiment, if a first quantity of designated symbols are generated, then the amount of budget credits is a first amount (or selected from a first range of amounts) and if a second, greater quantity of designated symbols are generated, then the amount of budget credits is a second, greater amount (or selected from a second, greater range of amounts). For example, as seen in FIG. 4A, upon generating three designated symbols 200*a*, 200*b* and 200*c* in a play of a primary game, the gaming system enables the player to select each of these generated designated symbols to reveal an amount of budget credits for the play of the secondary game. As seen in FIG. 4B, the player selected the three generated designated symbols to reveal a secondary budget of three-hundred budget credits (as indicated in secondary game budget 202). In this example, the gaming system presents appropriate messages such as "YOU TRIGGERED THE BONUS GAME", "PLEASE PICK THE BUILD-A-BUDGET SYMBOLS TO FIND OUR YOUR BONUS GAME BUDGET" and 'YOUR BUDGET IS 300 BUDGET CREIDTS", and "BUT WAIT . . . " to the player visually, or through suitable audio or audiovisual displays.

After determining the amount of budget credits for the play of the secondary game, but before enabling the player to participate in the secondary game, the gaming system enables the player to purchase additional budget credits as indicated in block 104 of FIG. 3. This amount of player purchased budget credits plus the determined amount of budget credits form a player's secondary game budget.

In one embodiment, the gaming system enables the player to utilize one or more wagering credits to purchase additional budget credits. In another embodiment, the gaming system enables the player to utilize one or more promotional credits to purchase additional budget credits. It should be appreciated that by enabling the player to use wagering credits (or promotional credits) to add to their amount of budget credits, the gaming system enables a player to at least partially control the amount of time the player will participate in the secondary game. That is, since the amount of budget credits in a player's budget determines, at least in part, the quantity of picks the player may make in the secondary game and since the quantity of picks corresponds to both a duration the player may participate in the secondary game and the award provided to the player in the secondary game, the player's post-secondary game trigger wagering or purchasing decisions determine one or more features, attributes or parameters of the triggered secondary game.

Figure 4C:
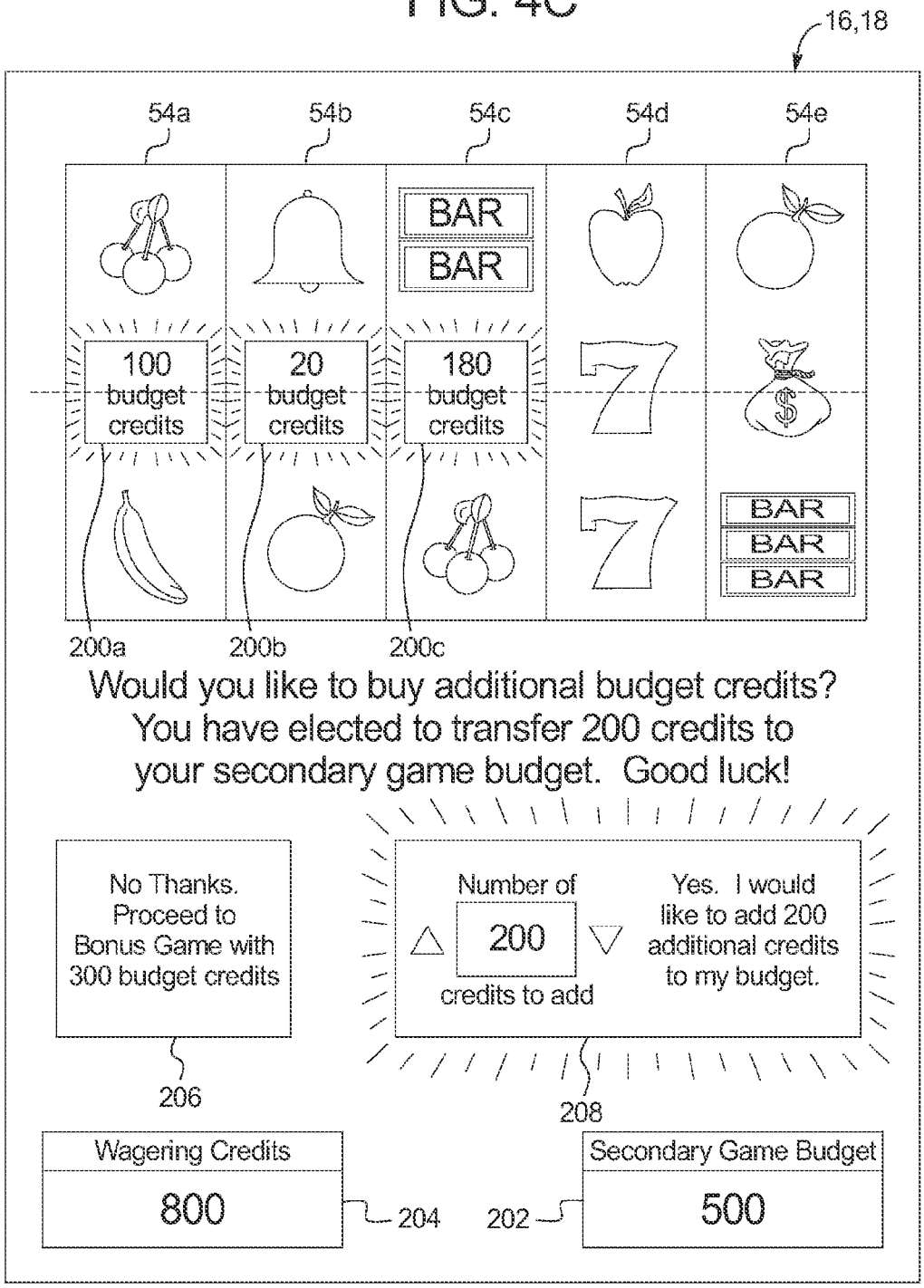

As seen in FIG. 4C, after determining the amount of budget credits for the play of the secondary game, the gaming system enables the player to either proceed directly to the secondary game 206 or to purchase additional budget credits for the secondary game 208. In this example, the player elected to purchase an additional two-hundred budget credits at a cost of two-hundred wagering credits. Accordingly, the two-hundred additional budget credits purchased by the player is reflected as a deduction in two-hundred wagering credits from the player's wagering credit meter 204 and an increase in two-hundred budget credits to the player's budget credit meter 202. In this example, the gaming system presents appropriate messages such as "WOULD YOU LIKE TO BUY ADDITIONAL BUDGET CREDITS?", "YOU HAVE ELECTED TO TRANSFER 200 CREDITS TO YOUR SECONDARY GAME BUDGET" and "GOOD LUCK" to the player visually, or through suitable audio or audiovisual displays.

After enabling the player to purchase any additional budget credits, as indicated in block 106 of FIG. 3, the gaming system displays to the player the player's secondary game budget. Such displaying of the amount of budget credits in the player's budget enables the player to make an informed decision regarding whether to continue the play of the secondary game or end the play of the secondary game as described below. Put differently, displaying the player's secondary game budget provides the player a unique experience in that the player sees what they have to work with and they can attempt to strategize for the play of the secondary game. That is, with a visible budget, the player can readily keep track of their overall win amount and attempt to manipulate the outcome of the secondary game.

As indicated in block 106, in addition to displaying the player's secondary game budget, the gaming system also displays to the player a plurality of selections. One or more of the selections are each associated with a masked award, such as a multiplier, a quantity of additional picks or an amount of award credits.

After displaying the plurality of available selections to the player, the gaming system enables the player to quit or terminate the play of the secondary game and determines whether the player selected to stop or quit the play of the secondary game as indicated in block 108 and diamond 110.

As indicated in block 112, if the player elects to quit the play of the secondary game, the gaming system transfers the amount of budget credits in the secondary game budget to a secondary game award meter. The gaming system then modifies the amount in the secondary game award meter by a secondary game multiplier as indicated in block 114. After such a modification, the gaming system provides the player the modified amount in the secondary game award meter and terminates the play of the secondary game as indicated in block 116 and 118. It should be appreciated that electing to quit the play of the secondary game represents a player's decision to accept an offer of any currently incremented secondary game multiplier times any amount of budget credits in the secondary game budget plus any amount of credits in the secondary game award meter.

On the other hand, if the player does not elect to quit the play of the secondary game, the gaming system enables the player to pick one of the displayed selections as indicated in block 120. The gaming system then reveals or displays to the player the award associated with the player picked selected as indicated in block 122.

Figure 5A:
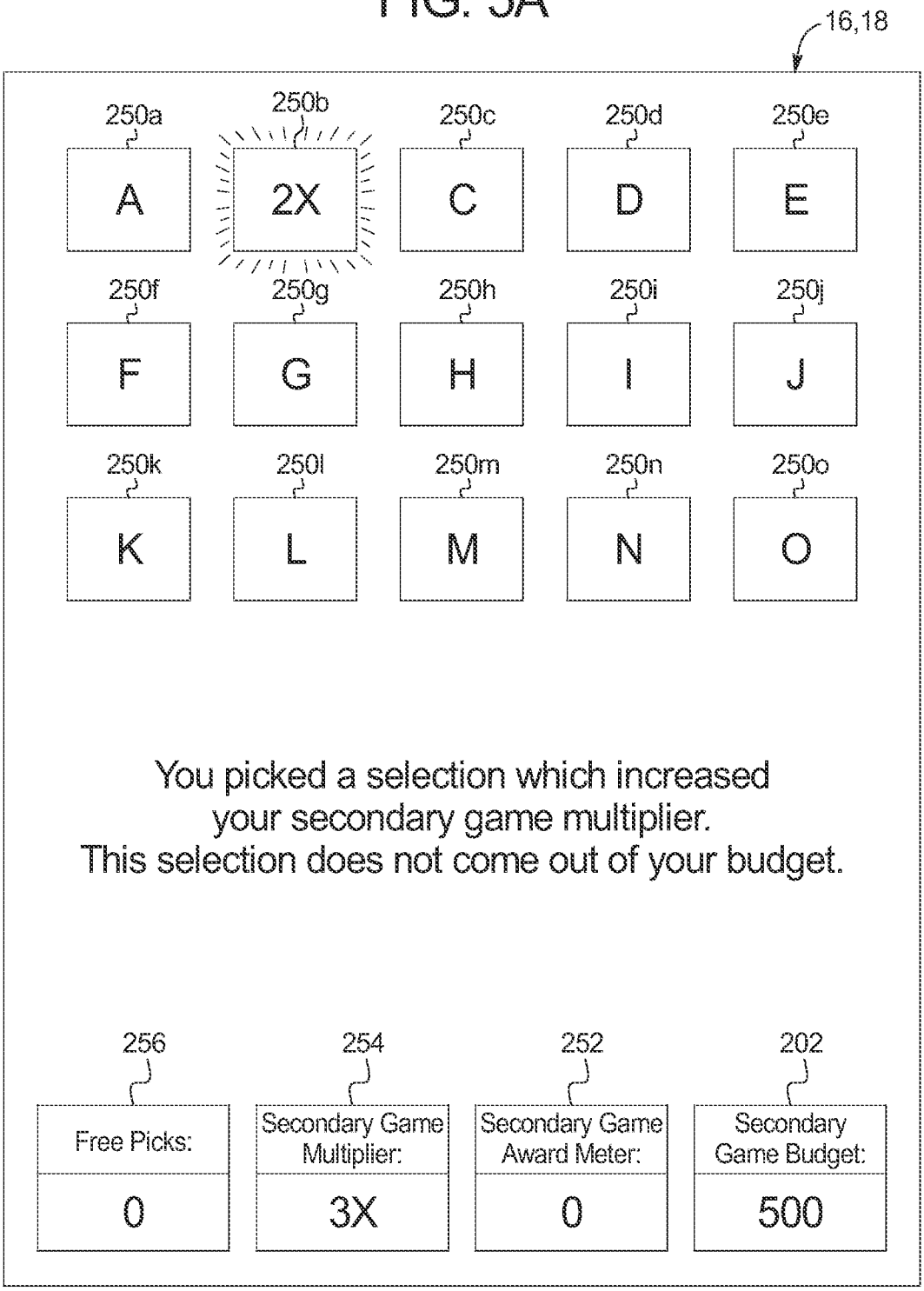
FIGS. 5A, 5B, 5C, 5D, 5E and 5F are front views of one embodiment of the gaming system disclosed herein illustrating different selections revealing different awards in a secondary game.

If the revealed award is a multiplier amount, as indicated in diamond 124 and block 126, the gaming system increases the secondary game multiplier by the revealed multiplier amount. For example, as seen in FIG. 5A, if the player picked selection 250*b* and the gaming system revealed that selection 250*b* is associated with a multiplier amount of 2×, then the gaming system will increase the secondary game multiplier from 1× (i.e., the default multiplier for the play of the secondary game) to 3× (as indicated in the secondary game multiplier meter 254). In this example, the gaming system presents appropriate messages such as "YOU PICKED A SELECTION WHICH INCREASED YOUR SECONDARY GAME MULTIPLIER" and "THIS SELECTION DOES NOT COME OUT OF YOUR SECONDARY GAME BUDGET" to the player visually, or through suitable audio or audiovisual displays. Following such an increase, the gaming system returns to block 108 of FIG. 3 and again enables the player to make one or more inputs to quit the play of the secondary game as described above. It should be appreciated that as seen in FIG. 5A, the pick of a selection associated with a multiplier amount does not affect the secondary game budget and thus represents an additional award that does not cost the player any budget credits.

Figure 5B:
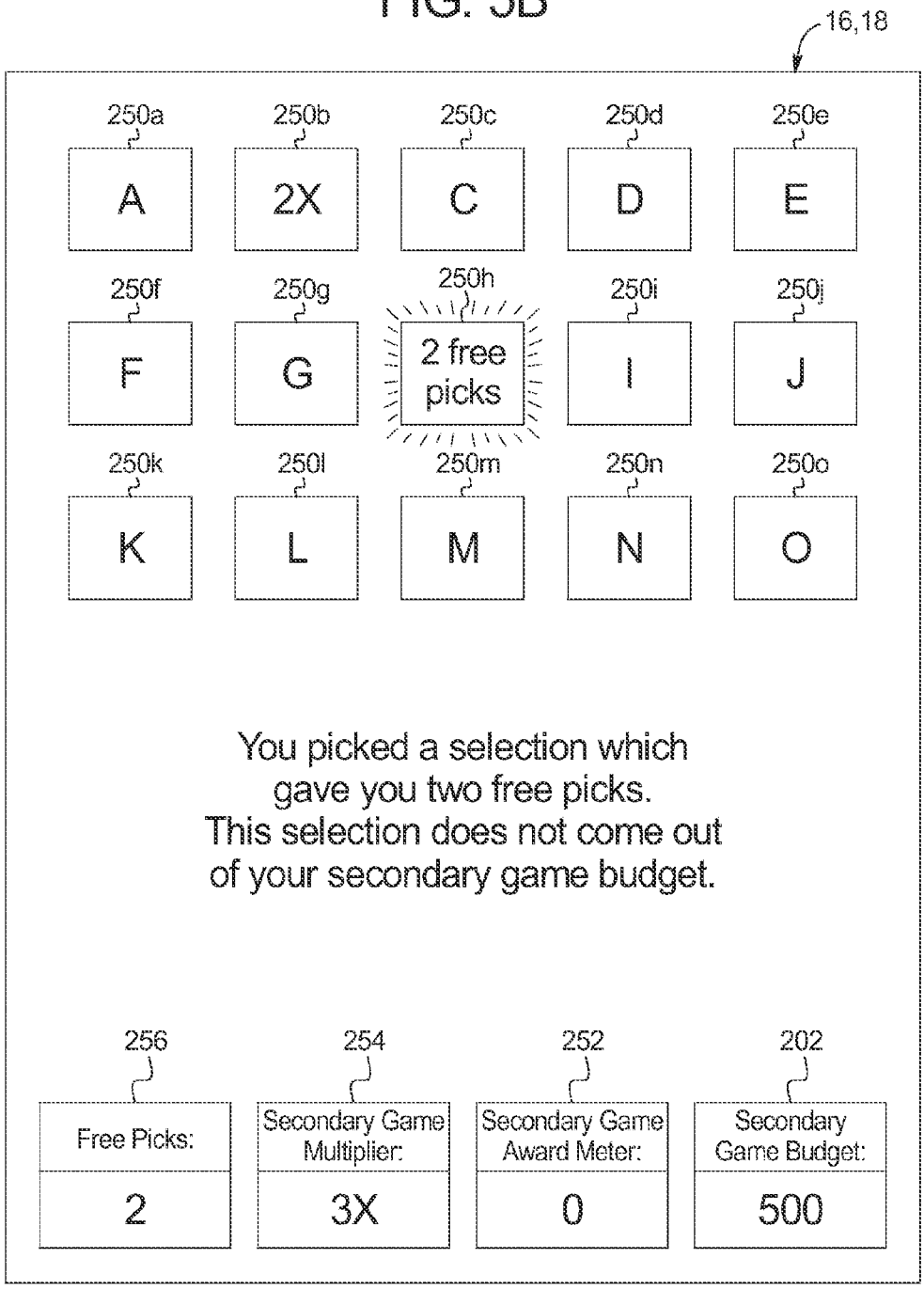

If the revealed award is a quantity of free picks, as indicated in diamond 128 and block 130 of FIG. 3, the gaming system accumulates the revealed quantity of free picks. For example, as seen in FIG. 5B, following the revelation of the multiplier amount in FIG. 5A and the player's decision to proceed with the play of the secondary game, the player picked selection 250*h* and the gaming system revealed that selection 250*h* is associated with two free picks (as indicated in the free picks meter 256). In this example, the gaming system presents appropriate messages such as "YOU PICKED A SELECTION WHICH GAVE YOU TWO FREE PICKS" and "THIS SELECTION DOES NOT COME OUT OF YOUR SECONDARY GAME BUDGET" to the player visually, or through suitable audio or audiovisual displays. Following such an accumulation, the gaming system returns to block 108 of FIG. 3 and again enables the player to make one or more inputs to quit the play of the secondary game as described above. It should be appreciated that as seen in FIG. 5B, the pick of a selection associated with a quantity of free picks does not affect the secondary game budget and thus represents an additional award that does not cost the player any budget credits.

Figure 5C:
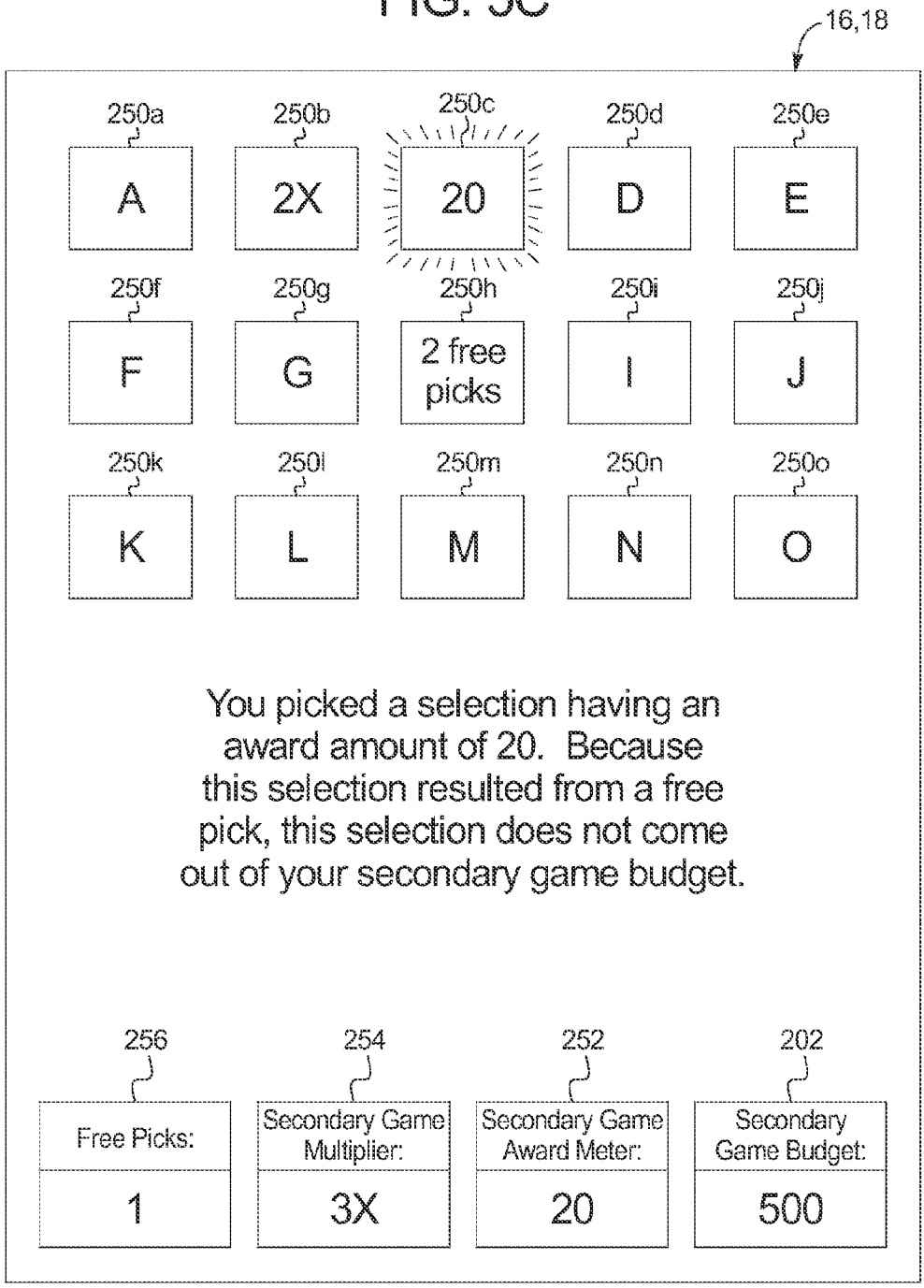
Figure 5D:
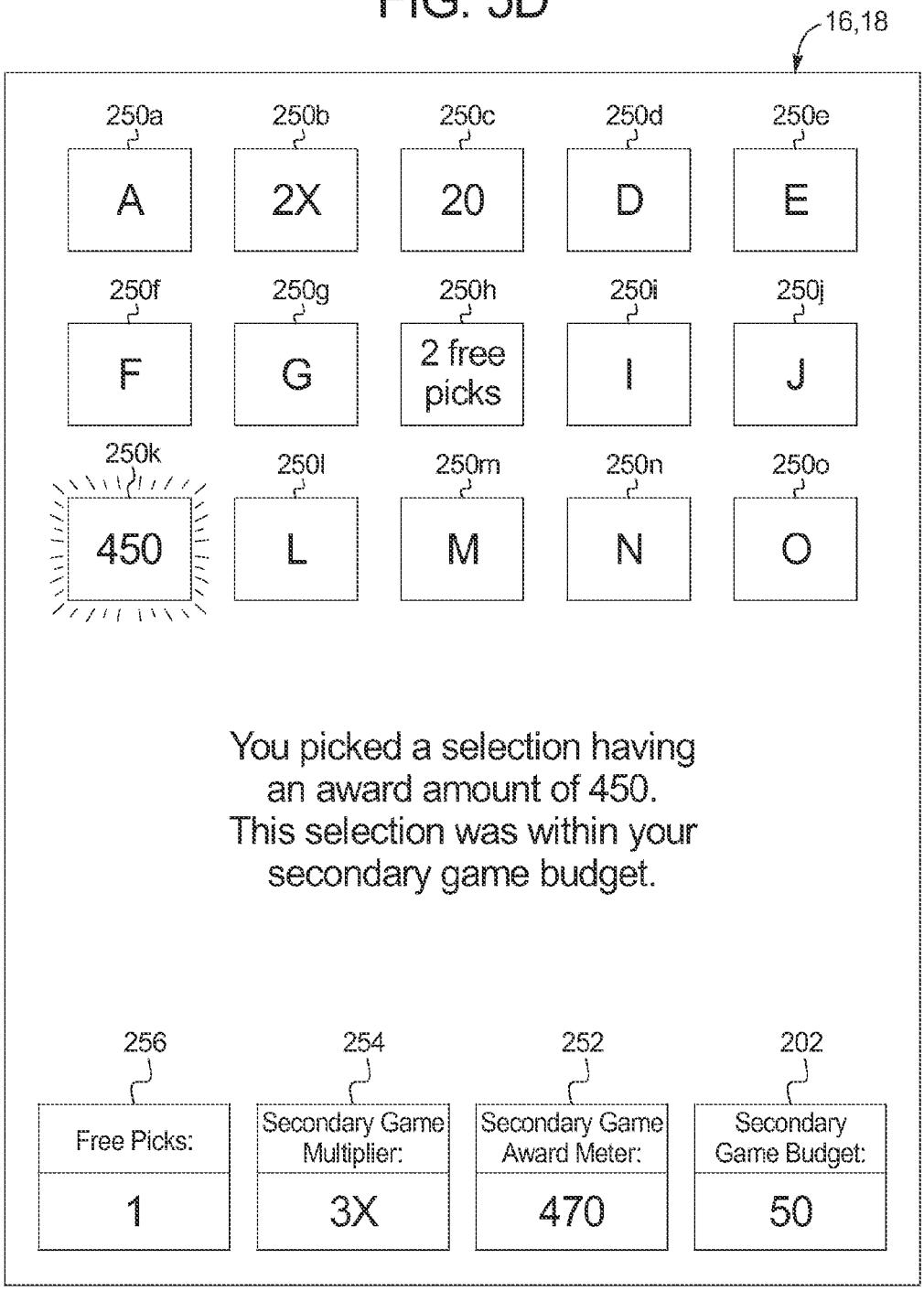

If the revealed award is an award amount and the selection was picked with an accumulated free pick as indicated in diamond 132 and block 134 of FIG. 3, the gaming system accumulates the award amount associated with the picked selection in the secondary game award meter. For example, as seen in FIG. 5C, using one of the two accumulated free picks, the player picked selection 250*c* and the gaming system revealed that selection 250*c* is associated with an award amount of twenty (which is credited in the secondary game award meter). In this example, the gaming system presents appropriate messages such as "YOU PICKED A SELECTION HAVING AN AWARD AMOUNT OF 20" and "BECAUSE THIS SELECTION RESULTED FROM A FREE PICK, THIS SELECTION DOES NOT COME OUT OF YOUR SECONDARY GAME BUDGET" to the player visually, or through suitable audio or audiovisual displays. Following such an accumulation, the gaming system returns to block 108 of FIG. 3 and again enables the player to make one or more inputs to quit the play of the secondary game as described above. It should be appreciated that as seen in FIG. 5D, the pick of a selection associated with an award amount which results from a free pick does not affect the secondary game budget and thus represents an additional award that does not cost the player any budget credits.

If the revealed award is an award amount and the selection was not picked with an accumulated free pick, the gaming system determines how this revealed award amount compares to the amount of budget credits in the player's secondary game budget. Specifically, if the revealed award is an award amount which is less than the amount of credits in the secondary game budget, then as indicated in diamond 136 and block 138 of FIG. 3, the gaming system transfer an amount of budget credits equal to the award amount associated with the picked selection from the secondary game budget to the secondary game award meter. Following such an accumulation, the gaming system returns to block 108 of FIG. 3 and again enables the player to make one or more inputs to quit the play of the secondary game as described above. For example, as seen in FIG. 5D, if the player picked selection 250*k* and the gaming system revealed that selection 250*k* is associated with an award amount of four-hundred-fifty credits, the gaming system transfers this four-hundred-fifty credits from the secondary game budget 202 to the secondary game award meter 252. In this example, the gaming system presents appropriate messages such as "YOU PICKED A SELECTION HAVING AN AWARD AMOUNT OF 450" and "THIS SELECTION WAS WITHIN YOUR BUDGET" to the player visually, or through suitable audio or audiovisual displays. As seen in this example, the gaming system is configured to convert a player's budget credits (which are obtained either as a result of one or more gaming system determinations or as a result of the player contributing monetary credits to purchase such budget credits) to award credits.

Figure 5E:
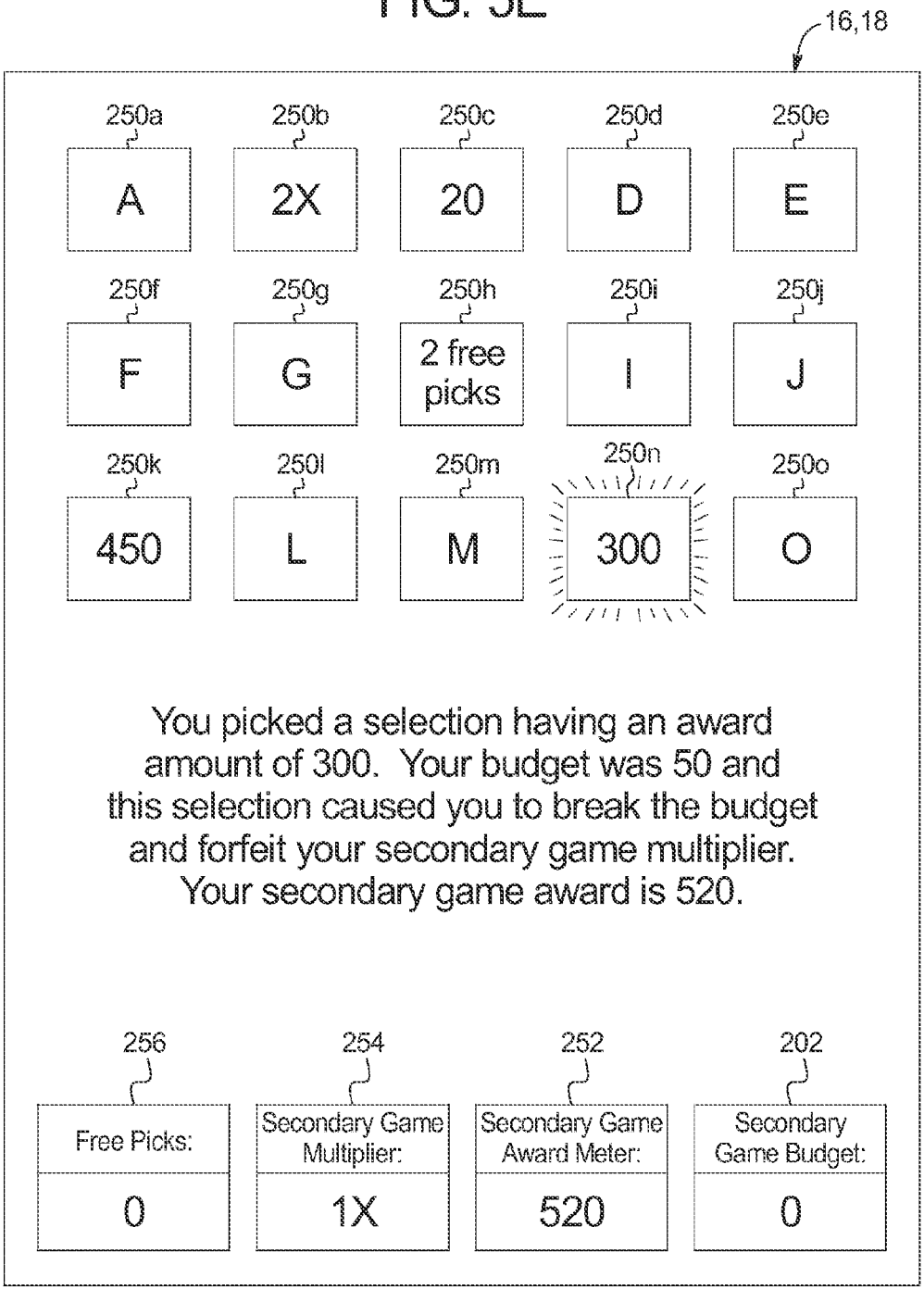

If the revealed award is an award amount which is greater than the amount of credits in the secondary game budget, then as indicated in diamond 140 and block 142 of FIG. 3, the gaming system transfer the amount of budget credits in the secondary game budget to the secondary game award meter. Following such a transfer, the gaming system provides the player the amount in the secondary game award meter and terminates the play of the secondary game as indicated in blocks 144 and 146. It should be appreciated that because the player has gone over their budget, the gaming system does not modify the secondary game award meter by any secondary game multiplier. That is, the gaming system is configured to cause the player to forfeit any previously accumulated multiplier (and thus potentially forfeit a lucrative award) if the player proceeds with the selection game and is unable to demonstrate the ability to stay on budget in picking selections. For example, as seen in FIG. 5E, following the player's selection in FIG. 5D and the player's subsequent use of a free pick (which resulted in a further increase of the secondary game multiplier to 5× (not shown)) if the player picked selection 250*n* and the gaming system revealed that selection 250*n* is associated with an award amount of three-hundred credits, since the player only has fifty budget credits remaining in the secondary game budget, the player has gone over budget in the secondary game. Accordingly, the gaming system transfers the last fifty budget credits from the secondary game budget 202 to the secondary game award meter 252 and reduces the secondary game multiplier to the default secondary game multiplier of 1×. The gaming system then provides the amount in the secondary game award meter to the player and terminates the play of the secondary game. In this example, the gaming system presents appropriate messages such as "YOU PICKED A SELECTION HAVING AN AWARD AMOUNT OF 300", "YOUR BUDGET WAS 50 AND THIS SELECTION CAUSED YOU TO BREAK YOUR BUDGET AND FORFEIT YOUR SECONDARY GAME MULTIPLIER" and "YOUR SECONDARY GAME AWARD IS 520" to the player visually, or through suitable audio or audiovisual displays.

Figure 5F:
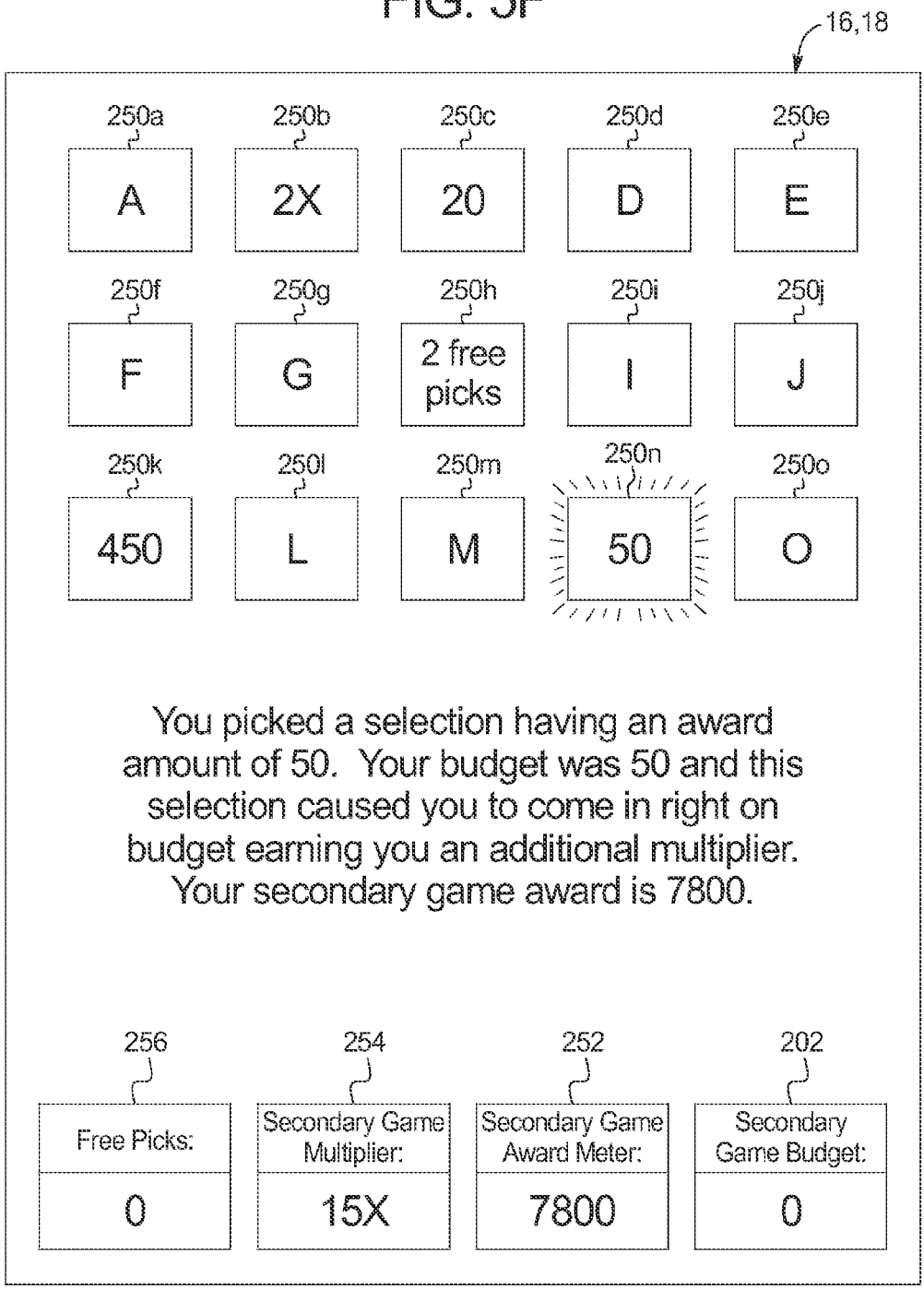

If the revealed award is an award amount which is equal to the amount of credits in the secondary game budget, then as indicated in diamond 140 and block 148 of FIG. 3, the gaming system transfer an amount of budget credits equal to the award amount associated with the picked selection from the secondary game budget to the secondary game award meter. Following such a transfer, the gaming system increases the secondary game multiplier by a designated multiplier amount and modifies the amount in the secondary game award meter by the secondary game multiplier as indicated in blocks 150 and 152. Following this modification, the gaming system provides the player the modified amount in the secondary game award meter and terminates the play of the secondary game as indicated in blocks 154 and 156. It should be appreciated that because the player has spent exactly their budget, the gaming system provides the player an additional multiplier. That is, the gaming system is configured to provide the player a relatively lucrative award if the player proceeds with the selection game and demonstrates the ability to stay on budget in picking selections. For example, as seen in FIG. 5F, following the player's selection in FIG. 5D and the player's subsequent use of a free pick (which resulted in a further increase of the secondary game multiplier to 5× (not shown)) if the player picked selection 250*n* and the gaming system revealed that selection 250*n* is associated with an award amount of fifty credits, since the player only has fifty budget credits remaining in the secondary game budget, the player has spent exactly their entire secondary game budget in the secondary game. Accordingly, the gaming system transfers the last fifty budget credits from the secondary game budget 202 to the secondary game award meter 252, increases the secondary game multiplier by 10× (i.e., the designated multiplier) to 15× and modifies the secondary game award meter of five-hundred-twenty by the 15× modifier. The gaming system then provides the modified amount in the secondary game award meter of seven-thousand-eight-hundred (520×15) to the player and terminates the play of the secondary game. In this example, the gaming system presents appropriate messages such as "YOU PICKED A SELECTION HAVING AN AWARD AMOUNT OF 50", "YOUR BUDGET WAS 50 AND THIS SELECTION CAUSED YOU TO COME IN RIGHT ON BUDGET EARNING YOU AN ADDITIONAL MULTIPLIER" and "YOUR SECONDARY GAME AWARD IS 7800" to the player visually, or through suitable audio or audiovisual displays.

Multipliers

In another embodiment, in addition to or as an alternative to one or more selections each being associated with a multiplier value, each pick the player makes (or each of a designated quantity of picks the player makes) is associated with an increase to the secondary game multiplier. In this embodiment, the secondary game multiplier starts at a default value, such as 1×, and each time the player picks a selection without going over their budget (or each of a designated quantity of picks the player makes without going over their budget), the secondary game multiplier is increased. In this embodiment, as described above, if the player picks a selection that has a value exceeding the current amount in the secondary game budget, any increased multiplier is forfeited (i.e., the secondary game multiplier returns to the default value) and the selection game ends. Accordingly, in this embodiment, the player is faced with the competing interests of increasing the secondary game multiplier by picking another selection versus risking going over the budget and losing any previous increase of the secondary game multiplier.

In another embodiment (not shown), rather than utilizing a default secondary game multiplier of 1×, the gaming system utilizes a default secondary game multiplier of 0×. In this embodiment, if no selections associated with any multiplier values are picked in association with a completed play of a secondary game, the gaming system does not modify the award amount in the secondary game award meter by any multiplier (and thus does not modify any secondary game award meter by any default secondary game multiplier of 0×).

Virtual Goods

In one embodiment, in addition to providing the player a secondary game award in association with the play of the secondary game, the gaming system is configured to provide the player one or more virtual items (for the player's avatar) in association with the play of the secondary game. In this embodiment, when a secondary game enrollment event occurs, the gaming system determines whether the player has previously enrolled to participate in the secondary game. In one such embodiment, a secondary game enrollment event occurs when a secondary game triggering event occurs. In another such embodiment, a secondary game enrollment event occurs when a player submits (such as inserting) a player tracking card or inputs other identification into the gaming device. In another such embodiment, a secondary game enrollment event occurs when an unidentified player places a wager on a play of a primary game. In another such embodiment, a secondary game enrollment event occurs when a player begins play at a dedicated account based gaming machine that is configured to play with a specific player.

In one embodiment, if the player has not previously enrolled to participate in the secondary game, the gaming system enables the player to design or select one or more characteristics or icons of a participant (e.g., an avatar) associated with that player. For example, in designing a participant, the gaming system enables the player to select one or more of a gender, clothing, body characteristics or features, facial characteristics or features, and/or celebration sounds or catch-phrases. On the other hand, if the player has previously enrolled to participate in the secondary game, the gaming system accesses a previously designed participant associated with the player. In one such embodiment, if the player has obtained any virtual items or goods (from purchasing such virtual goods and/or winnings such virtual goods in association with one or more plays of one or more primary games and/or bonus games), the gaming system enables the player to modify their existing designed participant with such virtual goods.

After designing a participant or avatar for the player or accessing a previously designed participant or avatar for the player, as described above, upon the occurrence of a secondary game triggering event, the gaming system displays a plurality of selections to the player. In this embodiment, one or more of the selections are each associated with a displayed virtual good or item. For example, the different selections available to be picked are different items of clothing for the player's avatar. In operation, if a player picks a selection associated with a displayed virtual item, the displayed virtual item is accumulated for the player's avatar and remains associated with the player's avatar after the conclusion of the secondary game. It should be appreciated that such an embodiment provides a player an opportunity to both win awards and accumulate avatar virtual goods or items in association with the same play of a secondary game. It should be further appreciated that by displaying the different selections as different virtual goods which the player may accumulate, certain players may pick selections based on accumulating a particular virtual good. That is, using virtual goods in the secondary game disclosed herein may affect the decisions (i.e., which selection to pick) of one or more players participating in the secondary game.

In an alternative embodiment, to account for the player repeatedly being offered the same virtual items to pick, the virtual goods made available to the player change. In one such embodiment, once a player accumulates a virtual good, that virtual good is no longer available to be picked by the player in a play of the secondary game. In another such embodiment, the virtual goods available in the secondary game change periodically, such as based on time or based on frequency of being picked. In another such embodiment, the virtual goods available in the secondary game are each associated with a theme or motif wherein at different points in time, different themes or motifs are utilized in association with the secondary game (and thus different virtual goods are available for selection in the secondary game.

Alternative Embodiments

In another embodiment, the gaming system determines an amount of budget credits for a play of a secondary game based on at least one play of a budget amount determination game. In different embodiments, one or more of budget amount determination games include, but are not limited to: a play of any suitable slot game, a play of any suitable free spins or free activations game, a play of any suitable wheel game, a play of any suitable card game, a play of any suitable offer and acceptance game, a play of any suitable award ladder game, a play of any suitable puzzle-type game, a play of any suitable persistence game, a play of any suitable selection game, a play of any suitable cascading symbols game, a play of any suitable ways to win game, a play of any suitable scatter pay game, a play of any suitable coin-pusher game, a play of any suitable elimination game, a play of any suitable stacked wilds game, a play of any suitable trail game, a play of any suitable bingo game, a play of any suitable video scratch-off game, a play of any suitable pick-until-complete game, a play of any suitable shooting simulation game, a play of any suitable racing game, a play of any suitable promotional game, a play of any suitable high-low game, a play of any suitable lottery game, a play of any suitable number selection game, a play of any suitable dice game, a play of any suitable skill game, a play of any suitable auction game, a play of any suitable reverse-auction game, a play of any suitable group game or a play of any other suitable type of game.

In another embodiment, in addition to stopping the play of the secondary game when the player decides to quit or when the player has utilized their entire secondary game budget, the gaming system stops the play of the secondary game when a designated quantity of selections have been picked. In this embodiment, when the designated quantity of selections have been picked by the player (i.e., when a final offer has been offered to the player), the gaming system terminates the play of the secondary game regardless of the amount in the player's secondary game budget.

In another alternative embodiment, rather than reducing the secondary game budget based on the player's picked selections, the gaming system increases the secondary game budget based on the player's picked selections. In this embodiment, the player attempts to keep their secondary game budget below a designated threshold value, wherein if the secondary game budget exceeds the designated threshold value, the gaming system deems the player to break their budget as described above.

As described above, certain awards associated with one or more selections of the triggered secondary game do not cause any reduction in the player's secondary game budget. In different embodiments, one or more of such awards associated with one or more selections include, but are not limited to:

a. a multiplier for the triggered secondary game;
b. a quantity of additional picks in the triggered secondary game;
c. a quantity of wild symbols in a play of a primary game and/or in a play of a bonus game;
d. a quantity of wild reels in a play of a primary game and/or in a play of a bonus game;
e. a quantity of retrigger symbols in a play of a primary game and/or in a play of a bonus game;
f. a quantity of terminators or termination symbols in a play of a primary game and/or in a play of a bonus game;
g. a quantity of anti-terminators in a play of a primary game and/or in a play of a bonus game;
h. a quantity of locking reels in a play of a primary game and/or in a play of a bonus game;
i. a quantity of locking symbol positions in a play of a primary game and/or in a play of a bonus game;
j. a quantity of expanding symbols in a play of a primary game and/or in a play of a bonus game;
k. a quantity of award opportunities in a play of a primary game and/or in a play of a bonus game;
l. a quantity of progressive awards in a play of a primary game and/or in a play of a bonus game;
m. a quantity of active reels in a play of a primary game and/or in a play of a bonus game;
n. a quantity of active paylines in a play of a primary game and/or in a play of a bonus game;
o. a paytable will be utilized in a play of a primary game and/or in a play of a bonus game;
p. a volatility of a play of a primary game and/or a play of a bonus game;
q. an average expected award of a play of a primary game and/or a play of a bonus game;
r. a quantity of hands of playing cards in a play of a primary and/or in a play of a bonus game;
s. a quantity of free spins in a play of a secondary game and/or in a play of a bonus game;
t. a quantity of free activations in a play of a primary game and/or in a play of a bonus game;
u. a quantity of rounds or levels in a play of a primary game and/or in a play of a bonus game;
v. any bonus game feature disclosed herein; and
w. any other suitable triggered secondary game feature.

It should be appreciated that in different embodiments, one or more of:

i. a determination of whether a gaming system triggering event occurs;
ii. an initial amount of budget credits in the secondary game budget;
iii. a determination of whether or not to enable the player to use wagering credits to add to their secondary game budget;
iv. a minimum quantity of wagering credits that may be added to a player's secondary game budget;
v. a maximum quantity of wagering credits that may be added to a player's secondary game budget;
vi. a quantity of selections in a play of the secondary game;
vii. the awards available in a play of the secondary game;
viii. which awards are associated with which selections in a play of the secondary game;
ix. a range of available awards in the triggered secondary game;
x. a maximum award in the triggered secondary game;
xi. a minimum award in the triggered secondary game;
xii. one or more characteristics of a player's participant or avatar;
xiii. one or more features of a player's participant or avatar;
xiv. any determination disclosed herein;

is/are predetermined, randomly determined, randomly determined based on one or more weighted percentages, determined based on a generated symbol or symbol combination, determined based on a random determination by the central controller, determined based on a random determination at the gaming system, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device which stores a plurality of instructions, which when executed by the at least one processor, cause the at least one processor to operate with the at least one input device and the at least one display device to, upon an occurrence of a secondary game triggering event:

(a) determine an amount of budget credits for a play of a secondary game, (b) receive an input from a player to purchase at least one additional budget credit, wherein any purchased budget credits and the determined amount of budget credits form a secondary game budget, (c) display a plurality of selections, wherein each selection is associated with a masked award, at least one of the awards is one of a plurality of award values and at least one of the awards is one of a plurality of multiplier values, and (d) if a final offer has not been formed:

(i) form an offer based on the secondary game budget, a secondary game award meter and a current value of a secondary game multiplier, (ii) display the formed offer, (iii) receive an input from the player to accept the formed offer, (iv) if the player accepts the formed offer, provide the accepted formed offer to the player, and (v) if the player does not accept the formed offer:

(A) receive an input from the player to pick one of the displayed selections, (B) display the award associated with the picked selection, (C) if the displayed award is one of the multiplier values:

(I) increase the current value of the secondary game multiplier, and (II) repeat (d) at least once, (D) if the displayed award is one of the award values and the displayed award value is greater than the secondary game budget:

(I) forfeit any increase to the secondary game multiplier, (II) form an award based on the secondary game budget and the secondary game award meter, and (III) provide the formed award to the player, and (E) if the displayed award is one of the award values and the displayed award value is less than the secondary game budget:

(I) increase the secondary game award meter by the revealed award value, (II) reduce the secondary game budget by the displayed award value, and (III) repeat (d) at least once.

2. The gaming system of claim 1, wherein when executed by the at least one processor, the plurality of instructions cause the at least one processor to, if the displayed award is one of the award values and the displayed award value is equal to the secondary game budget:

(A) increase the current value of the secondary game multiplier, (B) form a second award based on the secondary game budget, the secondary game award meter, and the current value of the secondary game multiplier, and (C) provide the formed second award to the player.

3. The gaming system of claim 1, wherein at least one of the awards is one of a plurality of additional selection picks.

4. The gaming system of claim 3, wherein when executed by the at least one processor, the plurality of instructions cause the at least one processor to accumulate any displayed additional selection picks, wherein any award value subsequently displayed in association with said accumulated additional selection picks does not reduce the secondary game budget.

5. The gaming system of claim 1, wherein at least one of the selections is associated with a virtual good.

6. The gaming system of claim 5, wherein when executed by the at least one processor, the plurality of instructions cause the at least one processor to accumulate, in association with a player avatar, any virtual good associated with any picked selection.

7. A method of operating a gaming system, said method comprising:

upon an occurrence of a secondary game triggering event:

(a) causing at least one processor to execute a plurality of instructions to determine an amount of budget credits for a play of a secondary game, (b) receiving an input from a player to purchase at least one additional budget credit, wherein any purchased budget credits and the determined amount of budget credits form a secondary game budget, (c) causing at least one display device to display a plurality of selections, wherein each selection is associated with a masked award, at least one of the awards is one of a plurality of award values and at least one of the awards is one of a plurality of multiplier values, and (d) if a final offer has not been formed:

(i) causing the at least one processor to execute the plurality of instructions to form an offer based on the secondary game budget, a secondary game award meter and a current value of a secondary game multiplier, (ii) causing the at least one display device to display the formed offer, (iii) receiving an input from the player to accept the formed offer, (iv) if the player accepts the formed offer, providing the accepted formed offer to the player, and (v) if the player does not accept the formed offer:

(A) receiving an input from the player to pick one of the displayed selections, (B) causing the at least one display device to display the award associated with the picked selection, (C) if the displayed award is one of the multiplier values:

(I) causing the at least one processor to execute the plurality of instructions to increase the current value of the secondary game multiplier, and (II) repeating (d) at least once, (D) if the displayed award is one of the award values and the displayed award value is greater than the secondary game budget:

(I) causing the at least one processor to execute the plurality of instructions to forfeit any increase to the secondary game multiplier, (II) causing the at least one processor to execute the plurality of instructions to form an award based on the secondary game budget and the secondary game award meter, and (III) providing the formed award to the player, and (E) if the displayed award is one of the award values and the displayed award value is less than the secondary game budget:

(I) causing the at least one processor to execute the plurality of instructions to increase the secondary game award meter by the revealed award value, (II) causing the at least one processor to execute the plurality of instructions to reduce the secondary game budget by the displayed award value, and (III) repeating (d) at least once.

8. The method of claim 7, which includes, if the displayed award is one of the award values and the displayed award value is equal to the secondary game budget:

(A) causing the at least one processor to execute the plurality of instructions to increase the current value of the secondary game multiplier, (B) causing the at least one processor to execute the plurality of instructions to form a second award based on the secondary game budget, the secondary game award meter, and the current value of the secondary game multiplier, and (C) providing the formed second award to the player.

9. The method of claim 7, wherein at least one of the awards is one of a plurality of additional selection picks.

10. The method of claim 9, which includes causing the at least one processor to execute the plurality of instructions to accumulate any displayed additional selection picks, wherein any award value subsequently displayed in association with said accumulated additional selection picks does not reduce the secondary game budget.

11. The method of claim 7, wherein at least one of the selections is associated with a virtual good.

12. The method of claim 11, which includes causing the at least one processor to execute the plurality of instructions to accumulate, in association with a player avatar, any virtual good associated with any picked selection.

13. The method of claim 7, which is provided through a data network.

14. The method of claim 13, wherein the data network is the internet.

15. A non-transitory computer readable medium including a plurality of instructions, which when executed by at least one processor, cause the at least one processor to, upon an occurrence of a secondary game triggering event:

(a) determine an amount of budget credits for a play of a secondary game, (b) receive an input from a player to purchase at least one additional budget credit, wherein any purchased budget credits and the determined amount of budget credits form a secondary game budget, (c) cause at least one display device to display a plurality of selections, wherein each selection is associated with a masked award, at least one of the awards is one of a plurality of award values and at least one of the awards is one of a plurality of multiplier values, and (d) if a final offer has not been formed:

(i) form an offer based on the secondary game budget, a secondary game award meter and a current value of a secondary game multiplier, (ii) cause the at least one display device to display the formed offer, (iii) receive an input from the player to accept the formed offer, (iv) if the player accepts the formed offer, provide the accepted formed offer to the player, and (v) if the player does not accept the formed offer:

(A) receive an input from the player to pick one of the displayed selections, (B) cause the at least one display device to display the award associated with the picked selection, (C) if the displayed award is one of the multiplier values:

(I) increase the current value of the secondary game multiplier, and (II) repeat (d) at least once, (D) if the displayed award is one of the award values and the displayed award value is greater than the secondary game budget:

(I) forfeit any increase to the secondary game multiplier, (II) form an award based on the secondary game budget and the secondary game award meter, and (III) provide the formed award to the player, and (E) if the displayed award is one of the award values and the displayed award value is less than the secondary game budget:

(I) increase the secondary game award meter by the revealed award value, (II) reduce the secondary game budget by the displayed award value, and (III) repeat (d) at least once.

16. The non-transitory computer readable medium of claim 15, wherein when executed by the at least one processor, the plurality of instructions cause the at least one processor to, if the displayed award is one of the award values and the displayed award value is equal to the secondary game budget:

(A) increase the current value of the secondary game multiplier, (B) form a second award based on the secondary game budget, the secondary game award meter, and the current value of the secondary game multiplier, and (C) provide the formed second award to the player.

17. The non-transitory computer readable medium of claim 15, wherein at least one of the awards is one of a plurality of additional selection picks.

18. The non-transitory computer readable medium of claim 17, wherein when executed by the at least one processor, the plurality of instructions cause the at least one processor to accumulate any displayed additional selection picks, wherein any award value subsequently displayed in association with said accumulated additional selection picks does not reduce the secondary game budget.

19. The non-transitory computer readable medium of claim 15, wherein at least one of the selections is associated with a virtual good.

20. The non-transitory computer readable medium of claim 19, wherein when executed by the at least one processor, the plurality of instructions cause the at least one processor to accumulate, in association with a player avatar, any virtual good associated with any picked selection.

* * * * *

UNITED STATES PATENT AND TRADEMARK OFFICE

CERTIFICATE OF CORRECTION

PATENT NO. : 8,414,385 B1
APPLICATION NO. : 13/324642
DATED : April 9, 2013
INVENTOR(S) : Amanda Tremblay et al.

It is certified that error appears in the above-identified patent and that said Letters Patent is hereby corrected as shown below:

IN THE CLAIMS

In Claim 1, Column 32, Line 2, replace “revealed” with --displayed--.
In Claim 7, Column 33, Line 25, replace “revealed” with --displayed--.
In Claim 14, Column 33, Line 61, replace “the” with --an--.
In Claim 15, Column 34, Line 43, replace “revealed” with --displayed--.

Signed and Sealed this
Twenty-third Day of July, 2013

Teresa Stanek Rea
*Acting Director of the United States Patent and Trademark Office*